US009175517B2

(12) United States Patent
Chan et al.

(10) Patent No.: US 9,175,517 B2
(45) Date of Patent: Nov. 3, 2015

(54) METHOD AND APPARATUS FOR CONTROLLING THE OPERATION OF CLUSTER DRILL OF DOWN-THE-HOLE HAMMERS

(71) Applicant: Top Mark Mechanical Equipment Limited, Hong Kong (HK)

(72) Inventors: Leung Choi Chan, Hong Kong (HK); Kin Choi Chan, Hong Kong (HK)

(73) Assignee: TOP MARK MECHANICAL EQUIPMENT LIMITED (HK)

( * ) Notice: Subject to any disclaimer, the term of this patent is extended or adjusted under 35 U.S.C. 154(b) by 302 days.

(21) Appl. No.: 13/763,354

(22) Filed: Feb. 8, 2013

(65) Prior Publication Data

US 2013/0206481 A1 Aug. 15, 2013

(51) Int. Cl.
*E21B 4/16* (2006.01)
*E21B 4/14* (2006.01)

(52) U.S. Cl.
CPC .... *E21B 4/14* (2013.01); *E21B 4/16* (2013.01)

(58) Field of Classification Search
CPC ..... E21B 4/06; E21B 4/14; E21B 4/16; E21B 1/00
See application file for complete search history.

(56) References Cited

U.S. PATENT DOCUMENTS

| | | | | |
|---|---|---|---|---|
| 3,299,971 | A | 1/1967 | Lewis | |
| 6,189,630 | B1 * | 2/2001 | Beck, III | 175/96 |
| 2001/0006120 | A1 | 7/2001 | Miyamoto et al. | |
| 2010/0018774 | A1 * | 1/2010 | Furuki | 175/65 |

FOREIGN PATENT DOCUMENTS

| | | | |
|---|---|---|---|
| CN | 2742112 | Y | 11/2005 |
| CN | 101949261 | A | 1/2011 |
| CN | 101967955 | A | 2/2011 |
| EP | 1354119 | B1 | 10/2006 |
| FR | 2623242 | A1 | 5/1989 |
| KR | 20110119365 | A | 11/2011 |

OTHER PUBLICATIONS

Examination report issued from Canadian Intellectual Property Office on May 6, 2014.
Office Action issued from State Intellectual Property Office of the P.R.C on Apr. 14, 2014.
Office Action issued from Federal Service for Intellectual Property (Rospatent) on Apr. 21, 2014.
Examination report issued from New Zealand Intellectual Property Office on Feb. 4, 2013.
Office Action issued from State Intellectual Property Office of the P.R.C on Oct. 14, 2014.

* cited by examiner

*Primary Examiner* — Brad Harcourt
(74) *Attorney, Agent, or Firm* — Ella Cheong Hong Kong; Sam T. Yip

(57) ABSTRACT

An apparatus for drilling hole, comprising: a cluster drill of down-the-hole (DTH) percussion hammers having two or more DTH percussion hammers; and a special distributor having rotatable swivels for sourcing compressed air or pressurized fluid from independent supply sources and distributing to the DTH percussion hammers; wherein the DTH percussion hammers are arranged such that one or more circumferential layers of drill bits are formed covering the drilling area; and wherein within each circumferential layer, at least one DTH percussion hammer is supplied with the compressed air or pressurized fluid from an independent supply source that is different from the independent supply source supplying the other DTH percussion hammers.

10 Claims, 4 Drawing Sheets

METHOD AND APPARATUS FOR CONTROLLING THE OPERATION OF CLUSTER DRILL OF DOWN-THE-HOLE HAMMERS

CLAIM FOR FOREIGN PRIORITY

This application claims priority under 35 U.S.C. §119 to the Hong Kong Short-term Patent No. HK1155608, filed Feb. 10, 2012, the disclosure of which is incorporated herein by reference in its entirety.

FIELD OF THE INVENTION

The present invention relates generally to civil building construction. More specifically, the present invention relates to techniques and equipments used in building structural foundation piling. Still more specifically, the present invention relates to methodology and equipment for controlling the operation of cluster drill of down-the-hole (DTH) percussion hammers for drilling in ground.

BACKGROUND

Conventional ground drilling equipments or techniques normally drill holes with a single or outer diameter (OD) target. Depending on the ground condition, a casing sometimes is inserted in the ground to prevent collapse of soil when the ground condition is loose. In the case where the ground strata are stable, no casing is necessary to be inserted to the ground. In either case, all the materials inside the hole will needed to be excavated away in the process of drilling.

The single DTH percussion hammer is well known in its use for general ground drilling. The DTH percussion hammer can be driven by either compressed air or pressurized fluid such as water.

A cluster drill of DTH percussion hammers is an implementation of a plurality of DTH hammers arranged and allocated in a cylindrical housing of which the OD defines the diameter of the hole drilled. One such implementation is shown in FIG. 1. The plurality of DTH hammers can also be arranged and allocated in an annulus housing having an OD and an inner diameter (ID) designed to drill ring holes with a particular size. One such implementation is shown in FIG. 2. In both cases, the OD of the hole to be drilled can range from a minimum of 300 mm to any diameter length. There is no theoretical maximum limit to the size of the hole as there can be many different possible arrangements of the plurality of DTH hammers. In the case of drilling annulus ring holes, the ID of annulus ring hole can range from a minimum of 200 mm to any larger diameter length.

Contemporary designs and arrangements for the cluster drill of DTH percussion hammers often have centralized supply sources of compressed air or pressurized fluid for their hammer driving mechanisms. The compressed air or pressurized fluid delivery paths branch out to all the DTH percussion hammers so that each of them can actuate its corresponding piston to strike on its front drill bit. With this configuration, the cluster drill of DTH percussion hammers assembly can hammer and penetrate homogenous hard materials or ground formation over its drilling area. In other words, when all the DTH percussion hammers are simultaneously impacting the homogenous hard materials or ground formation, there will be enough evenly distributed reaction force feedback on to the drill bits and in turn pushing back on to the pistons to facilitate the hammering cycle.

However, a problem arises in practice when the cluster drill of DTH percussion hammers is needed to drill mixed ground formation comprising materials of different rigidities. While the hard ground formation can provide enough reaction force feedback on to a drill bit to facilitate the continuation of hammering cycle of its corresponding piston, soft ground formation does not provide sufficient reaction force, causing the drill bit to drop and rest on the drill bit retaining ring. Following the drill bit, the piston also rests on top of it. The compressed air or pressurized fluid then escapes directly from the drill bit through the main exhaust holes in piston instead of going through the bottom chamber, which normally feeds the piston for the return stroke in a normal hammering cycle if the ground is hard enough to provide sufficient reaction force. At this point, the DTH hammer is at the maximum flushing position with the compressed air or pressurized fluid supplied to it being directly released out through its bottom of the drill bit. This condition is called the "direct exhaust phenomenon."

The condition described above is the result of that compressed air or pressurized fluid being delivered from a single centralized supply source for the operation of all the DTH percussion hammers in the cluster of DTH percussion hammers assembly. The direct exhaust phenomenon occurred in the DTH percussion hammers (or even in a single DTH percussion hammer) that are impacting soft ground. It led to the bypassing of all compressed air or pressurized fluid from the centralized supply source through these direct exhaust path(s) because of the much less flow resistance through the bottom of the drill bit(s); as opposed to the much higher flow resistance experienced when the compressed air or pressurized fluid is driven on the piston(s) of those DTH percussion hammer(s) that are impacting on hard ground.

Furthermore, due to the release of the compressed air or pressurized fluid through the lesser flow-resistive path(s) associated with the DTH percussion hammer(s) that are impacting soft ground; there is insufficient compressed air or pressurized fluid left to drive the other piston(s) of those DTH percussive hammer(s) that are impacting hard ground. Subsequently, the piston(s) of the DTH percussive hammer(s) that are impacting hard ground cease. Therefore, when the cluster drill of DTH percussion hammers encounter mixed ground formation during drilling, it cannot penetrate any more at that ground depth and the drilling cannot proceed further.

In fact, the aforementioned condition is the limitation of application of contemporary designs of cluster drills of DTH percussion hammers in drilling works, that is they can only be used in drilling homogeneous or competent rock strata, but not mixed ground formation. Therefore, there is a need for equipments and/or methodologies for controlling the operation of cluster drill of DTH percussion hammers for drilling mixed ground formation.

SUMMARY

It is an objective of the presently claimed invention to provide a method and an apparatus for controlling the operation of cluster drill of down-the-hole (DTH) percussion hammers. It is a further objective of the presently claimed invention to enable the cluster drill of DTH percussion hammers to drill not only in homogeneous ground formation, but also mixed ground formation comprising both hard and soft ground formation.

BRIEF DESCRIPTION OF THE DRAWINGS

Embodiments of the invention are described in more detail hereinafter with reference to the drawings, in which.

DETAILED DESCRIPTION

In the following description, methods and apparatus for controlling the operation of cluster drill of down-the-hole (DTH) percussion hammers and the like are set forth as preferred examples. It will be apparent to those skilled in the art that modifications, including additions and/or substitutions may be made without departing from the scope and spirit of the invention. Specific details may be omitted so as not to obscure the invention; however, the disclosure is written to enable one skilled in the art to practice the teachings herein without undue experimentation.

Figure 1:
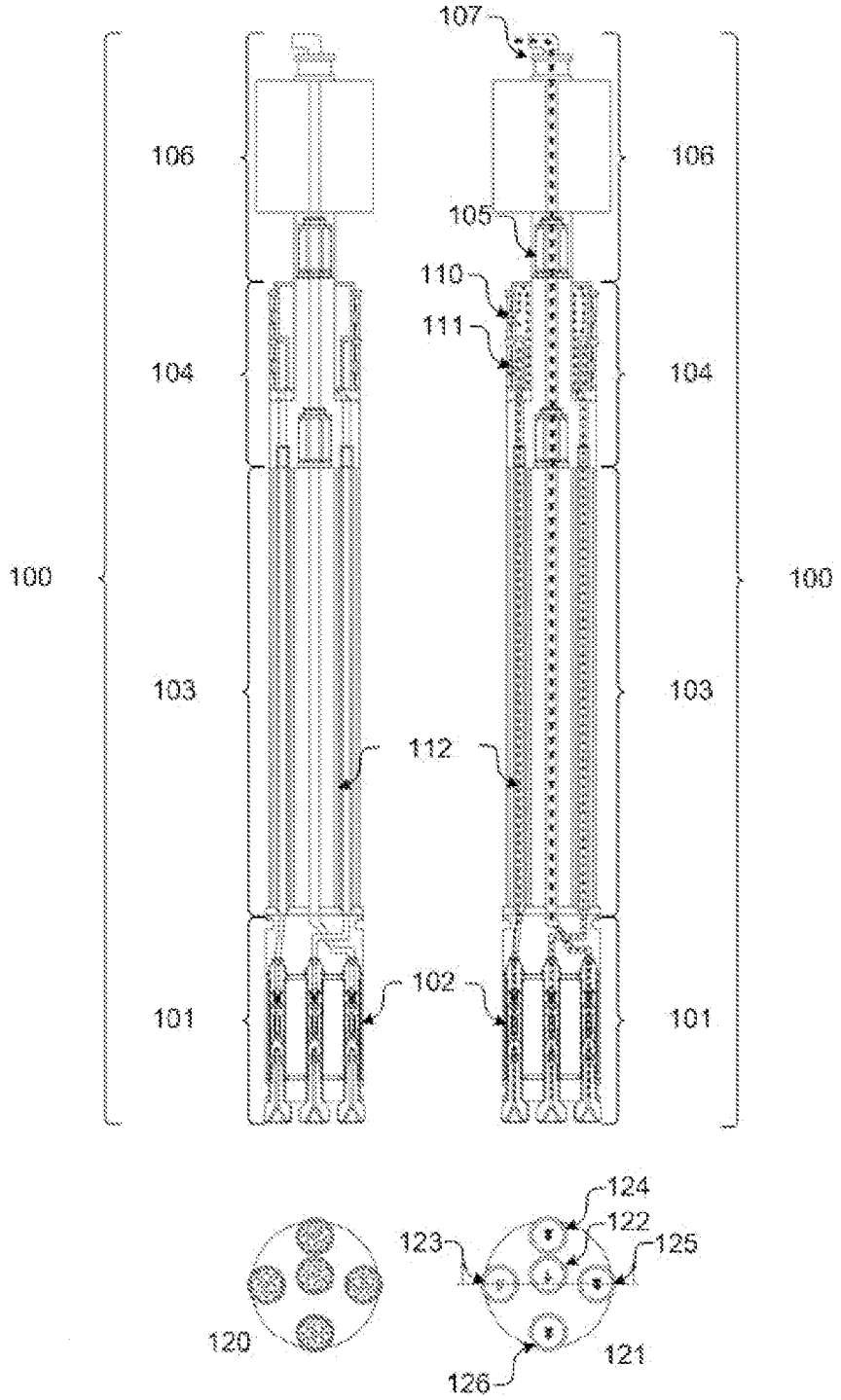
FIG. 1 shows the cross sectional view and the bottom views of an exemplary embodiment of a drill string that includes a cluster drill of DTH percussion hammers.

Referring to the cross sectional view of an exemplary embodiment of a drill string 100 as shown in FIG. 1. The drill string 100 includes a cluster drill of DTH percussion hammers 101, which includes one or more DTH hammers 102 arranged and allocated in either a cylindrical housing or an annulus housing; one or more drill pipes 103; a special distributor 104 of compressed air or pressurized fluid having one or more rotatable intake swivels, such as 110 and 111 as shown, for sourcing the compressed air or pressurized fluid; and a rotary head connection interface 105 for connecting a rotary head 106. In some cases of shallow drilling, no drill pipe is necessary.

The cluster drill of DTH percussion hammers 101 includes one or more DTH hammers 102 arranged and allocated in either a cylindrical housing or an annulus housing. With cylindrical housing, the housing OD defines the diameter of the circular hole drilled. With annulus housing, the size of the annulus ring hole drilled is determined by the OD and ID of the annulus housing. The cluster drills of DTH percussion hammers in cylindrical housing and annulus housing are two typical embodiments. The presently claimed invention is applicable to many modifications and variations of cluster drill of DTH percussion hammer designs that are apparent to the practitioner skilled in the art.

In accordance to an embodiment of the presently claimed invention, the special distributor 104 of compressed air or pressurized fluid comprises one or more rotatable intake swivels, such as 110 and 111 as shown, for sourcing the compressed air or pressurized fluid. The one or more rotatable intake swivels are constructed purposely to allow independent supply of compressed air or pressurized fluid from each rotatable swivel to drive the DTH percussion hammers of the cluster drill. This is in contrast to the conventional design of using a single centralized supply source of compressed air or pressurized fluid to drive all the DTH percussion hammers. The number of rotatable swivels needed depends on the configuration and size of the cluster drill of DTH percussion hammers.

Figure 4:
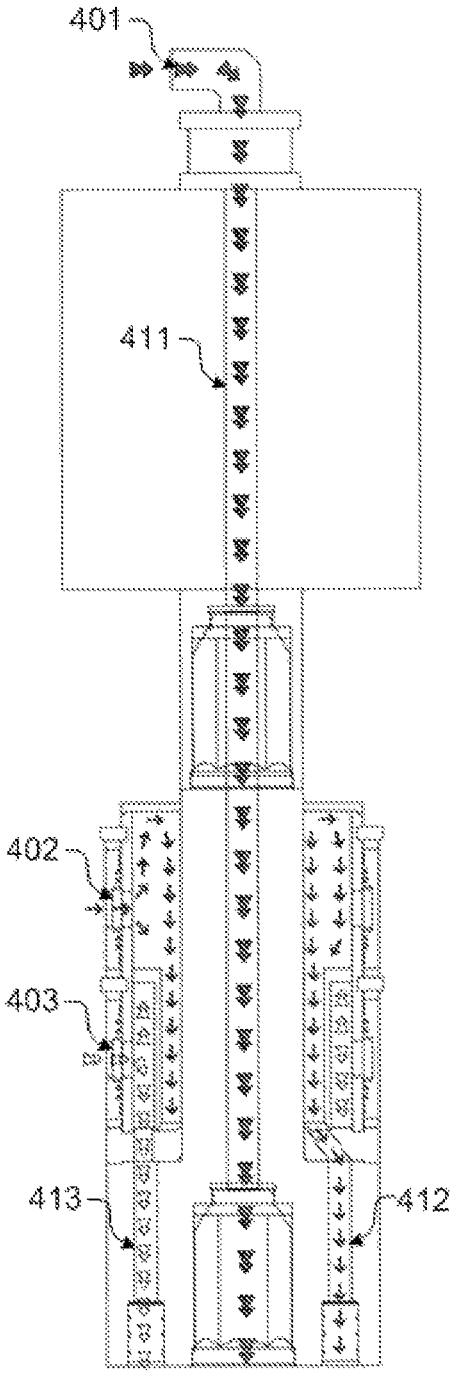
FIG. 4 shows the magnified cross sectional view of the rotary head and the special distributor of one embodiment and illustrates the flow of compressed air or pressurized fluid from multiple sources.

The rotary head 106 provides rotational turning speed and output torque for the drill string 100. The rotary head 106 is also equipped with an intake swivel 107 where compressed air or pressurized fluid is supplied from a source, which can be independent of those supplying the special distributor 104 through its one or more rotatable intake swivels. The compressed air or pressurized fluid is then delivered through the internal channel in the rotary head 106 to the internal channel in the rotary head connection interface 105. FIG. 4 shows the magnified cross sectional view of the rotary head and the special distributor. Different sources of compressed air or pressurized fluid are supplying through the intake swivel 401 of the rotary head and the rotatable intake swivels 402 and 403 of the special distributor; and the compressed air or pressurized fluid travel through separate paths 411, 412, and 413 respectively to the corresponding DTH percussion hammers.

One or more drill pipes 103 are attached vertically, providing the extension lengths for the drill string 100 to meet the drill depth requirement. Internal delivery pipes 112 are equipped from top to bottom inside each of the drill pipes 103. Compressed air or pressurized fluid is delivered through the internal delivery pipes 112 and reaches the cluster drill of DTH percussion hammers 101. When two drill pipes are vertically attached, their respective delivery pipes are internally aligned and connected, forming the continuous delivery channels for the compressed air or pressurized fluid supplied through the rotatable swivels of the special distributor 104 and the intake swivel of the rotary head 106. Each DTH percussion hammer is connected to one delivery pipe. The drill pipes 103 also transfer the rotational torque from the rotary head 106 to the cluster drill of DTH percussion hammers 101. In some cases of shallow drilling, no drill pipe is necessary. In those cases, the cluster drill of DTH percussion hammers 101 is directly connected to the special distributor 104.

Depending on the requirement of the hole to be drilled, various allocation arrangements of the drill bits are possible. In the case of annulus ring hole, if the difference between the annulus ring hole OD and ID is small, one circumferential layer of drill bits is used. For an annulus ring hole with a large OD-ID difference, two or more circumferential layers of drill bits can be used to cover the large annulus ring drilling area. Similarly for drilling large circular holes, two or more circumferential layers of drill bits can be used to cover the drilling area.

Referring to the bottom views 120 and 121 of an exemplary configuration of a cluster drill of DTH percussion hammers shown in FIG. 1, in which two circumferential layers of drill bits are arranged from the center of the cluster drill of DTH percussion hammers 101 to its outermost diameter as viewed from the bottom. The drilling area that can be formed by each drill bit is governed by the swept area produced by its revolving motion about the rotational axis of the cluster drill of DTH percussion hammers 101. It is common to allocate the drill bits in cluster drill in such a way that summation of the drilling area formed by all drill bits located at different radial distance from the center of the cluster drill will fully cover the entire cluster drill bottom face area.

Figure 2:
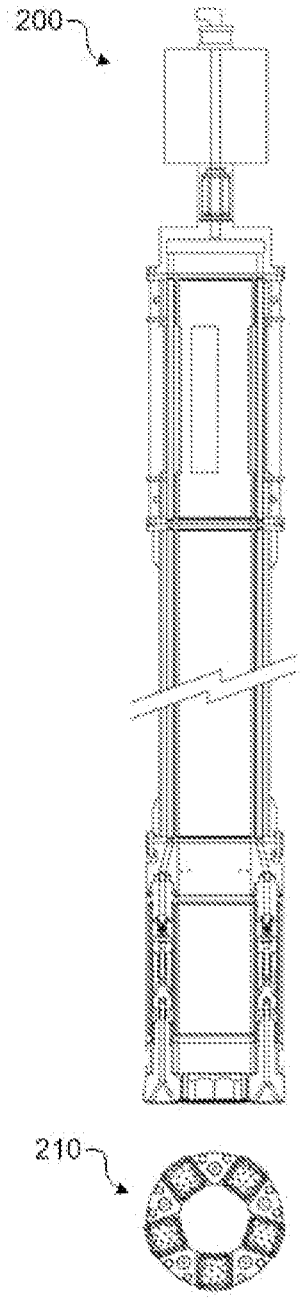
FIG. 2 shows the cross sectional view and the bottom view of one embodiment of a drill string for annulus ring hole drilling.
Figure 3:
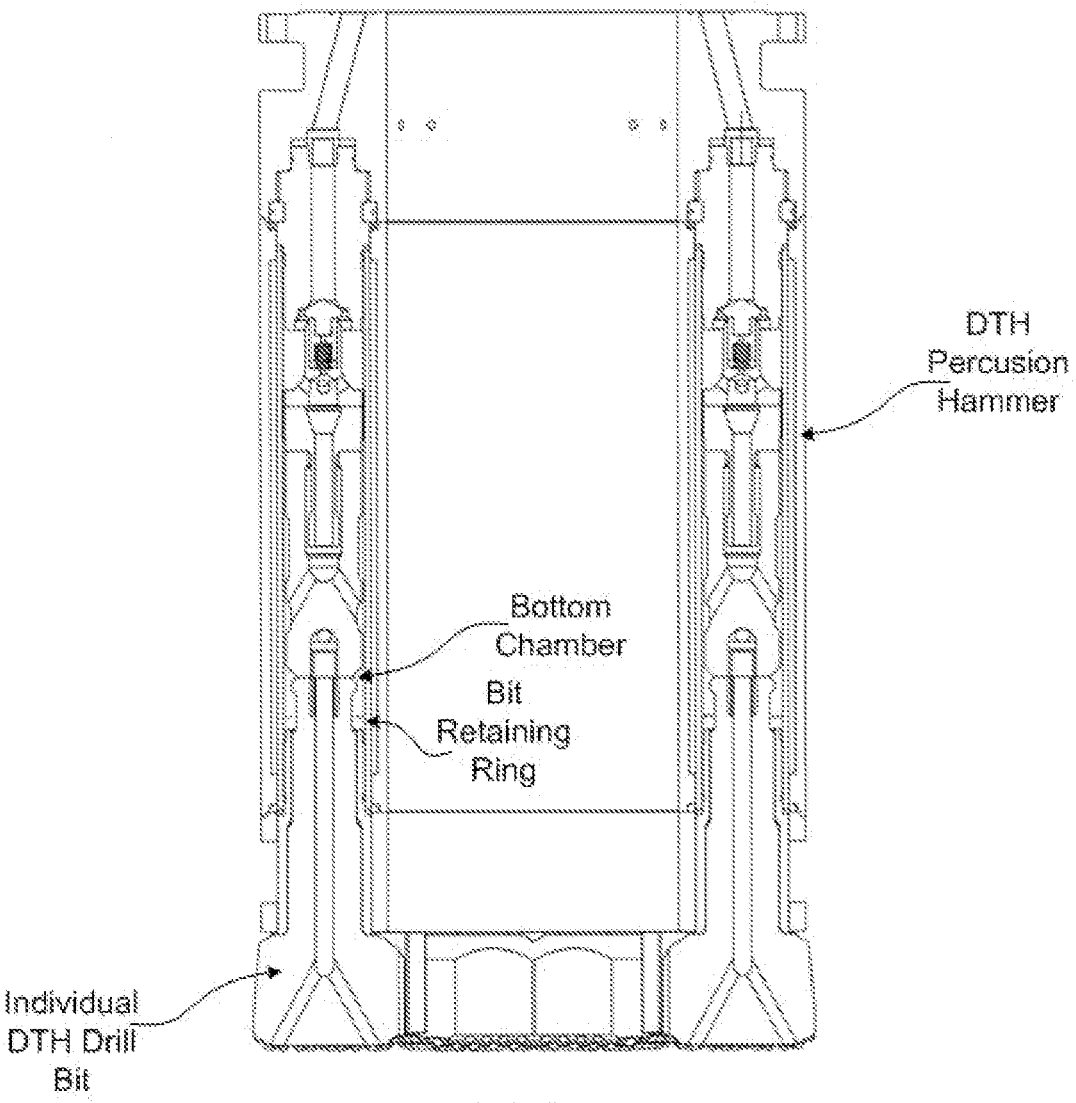
FIG. 3 shows the cross sectional view of one embodiment of the cluster drill of DTH percussion hammers for annulus ring hole drilling.

Referring to FIG. 2. Another exemplary configuration of a cluster drill of DTH percussion hammers is shown. As shown by the bottom view 210, one circumferential layer of drill bits is used in an annulus ring housing for drilling annulus ring holes.

In accordance to an embodiment of presently disclosed invention, within each circumferential layer of drill bits there is at least one drill bit's corresponding DTH percussion hammer is supplied with an independent source of compressed air or pressurized fluid through one of the rotatable swivels, such as 110 and 111, of the special distributor 104, or the intake swivel 107 of the rotary head 106.

For the exemplary configuration of a cluster drill of DTH percussion hammers as shown in FIG. 1, since there are two circumferential layers, there are at least two independent supply sources of compressed air or pressurized fluid and three rotatable swivels in the special distributor 104. In this exemplary embodiment, the inner circumferential layer of drill bits comprises only one drill bit 122. Its DTH percussion hammer is supplied with compressed air or pressurized fluid from an independent supply source through the rotatable swivel 110 of the special distributor 104. The outer circumferential layer comprises four drill bits 123, 124, 125, and 126. The DTH percussion hammer of drill bit 123 is selected to be independently supplied with compressed air or pressurized fluid from an independent supply source through the rotatable swivel 111 of the special distributor 104. The DTH percussion hammers of drill bit 124, 125, and 126 are supplied with compressed air or pressurized fluid from a central supply source through the intake swivel of the rotary head.

In the situation where the drill bit 124, 125, or 126 hit on mixed ground formation during drilling and causes direct exhaustion of the compressed air or pressurized fluid from the central supply source—direct exhaust phenomenon. However, since the DTH percussion hammer of drill bit 123 is supplied by an independent compressed air or pressurized fluid source, it can continue to hammer and penetrate the mixed ground. Once more solid rock strata are reached, the halted DTH percussion hammers of drill bit 124, 125, or 126 can restart hammering.

In accordance with various embodiments, specially designed percussion drill bits with tungsten carbide tips are mounted at the bottom of each drill bit. The drill bit has a special peripheral profile to achieve a larger percussion area on both the annulus OD and ID drilling areas. The drill bit cutting face profile is not necessary circular in shape, and can be triangular, rectangular, or any special profiled shape.

The foregoing description of the present invention has been provided for the purposes of illustration and description. It is not intended to be exhaustive or to limit the invention to the precise forms disclosed. Many modifications and variations will be apparent to the practitioner skilled in the art.

The embodiments were chosen and described in order to best explain the principles of the invention and its practical application, thereby enabling others skilled in the art to understand the invention for various embodiments and with various modifications that are suited to the particular use contemplated. It is intended that the scope of the invention be defined by the following claims and their equivalence.

What is claimed is:

1. An apparatus for drilling hole, comprising:

a cluster drill of down-the-hole (DTH) percussion hammers, the cluster drill of DTH percussion hammers comprising two or more DTH percussion hammers each equipped with a drill bit;

a special distributor for distributing compressed air or pressurized fluid from two or more independent supply sources to the cluster drill of DTH percussion hammers, the special distributor being connected to the cluster drill of DTH percussion hammers; and a rotary head for providing rotational turning speed and output torque for the apparatus, the rotary head being connected to the special distributor;

wherein each of the DTH percussion hammers is supplied with the compressed air or pressurized fluid from one of the two or more independent supply sources;

wherein not all of the DTH percussion hammers are supplied with the compressed air or pressurized fluid from the same independent supply source; and wherein the apparatus being further characterized in that the cluster drill of DTH percussion hammers is adapted to drill in both homogenous and mixed ground formations, such that when one or more of the DTH percussion hammers are impacting soft ground and causing direct exhaustion of the compressed air or pressurized fluid supplying the particular one or more of the DTH percussion hammers, the rest of the DTH percussion hammers continue being pressurized and hammering.

2. The apparatus of claim 1, wherein the special distributor having two or more rotatable swivels for sourcing the compressed air or pressurized fluid from the independent supply sources, and each of the rotatable swivels is sourcing one of the independent supply sources.

3. The apparatus of claim 1, wherein the rotary head having an intake swivel for sourcing the compressed air or pressurized fluid from one of the independent supply sources.

4. The apparatus of claim 1, wherein the DTH percussion hammers are arranged in a cylindrical housing for drilling circular holes; wherein the housing outer diameter defines diameter of a circular hole drilled.

5. The apparatus of claim 1, wherein the DTH percussion hammers are arranged in an annulus housing for drilling annulus holes; wherein the housing outer diameter defines outer diameter of an annulus hole drilled and the housing inner diameter defines inner diameter of the annulus hole drilled.

6. The apparatus of claim 4, wherein the DTH percussion hammers are arranged such that two or more circumferential layers of drill bits are formed covering a circular drilling area.

7. The apparatus of claim 5, wherein the DTH percussion hammers are arranged such that two or more circumferential layers of drill bits are formed covering an annulus drilling area.

8. The apparatus of claim 6, wherein within each of the circumferential layers, at least one of the DTH percussion hammers is supplied with the compressed air or pressurized fluid from one of the independent supply sources that is different from the independent supply source supplying the other DTH percussion hammers.

9. The apparatus of claim 7, wherein within each of the circumferential layers, at least one of the DTH percussion hammers is supplied with the compressed air or pressurized fluid from one of the independent supply sources that is different from the independent supply source supplying the other DTH percussion hammers.

10. The apparatus of claim 1, further comprising one or more drill pipes, the drill pipes being attached vertically with each other forming a string of drill pipes, the string of drill pipes being connected at a first end to the cluster drill of DTH percussion hammers, and the string of drill pipes being connected at a second end to the special distributor; wherein the drill pipes having two or more internal delivery pipes within for delivering the compressed air or pressurized fluid from the special distributor and the rotary head to the DTH percussion hammers.

* * * * *